US005428965A

United States Patent [19]

Grunwald et al.

[11] Patent Number: 5,428,965

[45] Date of Patent: Jul. 4, 1995

[54] MOTOR CONTROL FOR REFRIGERATION APPLIANCE

[75] Inventors: Stefan H. Grunwald, Ohio Township, Warrick County; Vincent P. Anderson, Center Township, Vanderburgh County; Edward J. Laughlin, Cass Township, Dubois County; Ronald J. Duncan, Evansville, all of Ind.

[73] Assignee: Whirlpool Corporation, Benton Harbor, Mich.

[21] Appl. No.: 164,716

[22] Filed: Dec. 10, 1993

[51] Int. Cl.[6] ..... F25D 19/00; F01D 5/10

[52] U.S. Cl. ..... 62/180; 62/296; 62/228.4; 181/202; 381/71; 415/119

[58] Field of Search ..... 62/296, 180–228.4; 181/202; 381/94, 71; 417/22, 42; 318/268, 163; 454/906; 123/350

[56] References Cited

U.S. PATENT DOCUMENTS

| | | | |
|---|---|---|---|
| 3,195,034 | 7/1965 | Bensema | 318/460 |
| 4,171,931 | 10/1979 | Harada | 417/22 |
| 4,604,036 | 8/1986 | Sutou et al. | 417/18 |
| 4,726,738 | 2/1988 | Nakamura et al. | 417/22 |
| 4,992,715 | 2/1991 | Nakamura et al. | 318/649 |
| 5,009,084 | 4/1991 | Tanaka et al. | 62/441 |
| 5,010,739 | 4/1991 | Isshiki et al. | 181/175 X |
| 5,018,357 | 5/1991 | Livingstone et al. | 62/6 |
| 5,117,642 | 6/1992 | Nakanishi et al. | 181/206 X |
| 5,125,241 | 6/1992 | Nakanishi et al. | 381/71 X |
| 5,127,235 | 7/1992 | Nakanishi et al. | 381/71 X |
| 5,203,178 | 4/1993 | Shyu | 62/296 |

FOREIGN PATENT DOCUMENTS

| | | | |
|---|---|---|---|
| 0086809 | 7/1981 | Japan | 62/296 |
| 272483 | 2/1986 | Japan | 62/296 |
| 0261683 | 11/1987 | Japan | 62/296 |

*Primary Examiner*—William E. Wayner

*Attorney, Agent, or Firm*—Hill, Steadman & Simpson

[57] ABSTRACT

A microprocessor speed control system for a refrigeration apparatus for controlling a speed of at least one variable speed motor is provided. The control system has an input for receiving demands to vary a speed of the motor and a memory where certain predetermined speed ranges are kept in a means for preventing the motor from being operated at the predetermined speed ranges. The predetermined speed ranges can be based upon speed ranges which cause excessive noise or vibration in the refrigeration appliance or any of its components.

15 Claims, 2 Drawing Sheets

MOTOR CONTROL FOR REFRIGERATION APPLIANCE

BACKGROUND OF THE INVENTION

The present invention relates to a control system and method of operation of a refrigeration device to reduce or avoid excessive noise and vibrations due to operation of motors and fans in the device.

SUMMARY OF THE INVENTION

A microprocessor speed control system is provided for a refrigeration apparatus such as refrigerator or air conditioner. The control system is used to control the speed of one or more variable speed motors, such as fan motors, compressor motors, etc.

The microprocessor control has an input for receiving demand signals, such as from a thermister or other similar components, to vary the speed of the various motors in order to increase or decrease the rate of cooling provided within the refrigeration device. Since the refrigeration device is constructed within a cabinet or housing and includes various frame members and other components, it has a natural or resonant frequency in which vibrations at that frequency will cause excessive noise to be generated. The various components of the cabinet or housing and refrigeration device may also have natural or resonant frequencies, thus there are a number of frequencies at which excessive noise will be generated. Due to the fact that the motors operate at varying frequencies, it is possible that one or more of the motors will be operated at one of the resonant frequencies, thus causing an increase in the noise level. Further, when two or more motors are operated at certain similar or different frequencies simultaneously, the combination of those frequencies may also result in excessive noise or vibration.

In order, to determine what the noise producing frequencies are, empirical studies must be conducted by operating each of the motors throughout its range of frequencies and detecting at which frequencies excessive noise or vibration levels result. The microprocessor speed control system is provided with a memory in which these empirically determined frequencies can be stored for each specific motor. Then, as the refrigeration apparatus is operated, as demands are received by the microprocessor to operate one of the motors in a speed range previously determined as generating excess noise or vibration, the control will prevent that motor from operating at that speed. Preferably the control will operate the motor at a lower speed than that demanded for a first period of time and then at a second, higher speed than that demanded for a second period of time such that the combination of the two speeds and times will approximate the effect of operating the motor at the demanded speed. A feedback control loop is provided for each of the motors to assure that the motors are being operated at speeds outside of those previously determined to cause excessive noise or vibration.

DETAILED DESCRIPTION OF THE PREFERRED EMBODIMENTS

Figure 1:
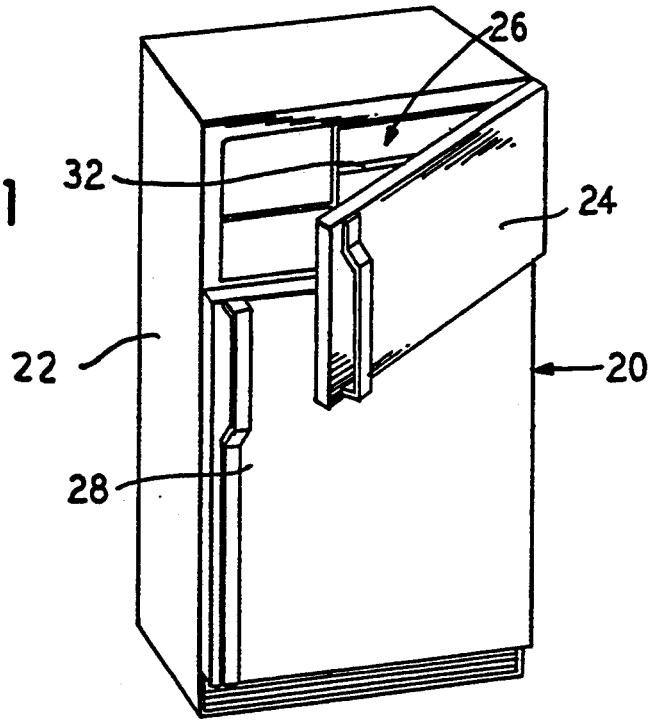
FIG. 1 is a perspective view of a refrigeration appliance in which the method and apparatus embodying the principles of the present invention may be used.
Figure 2:
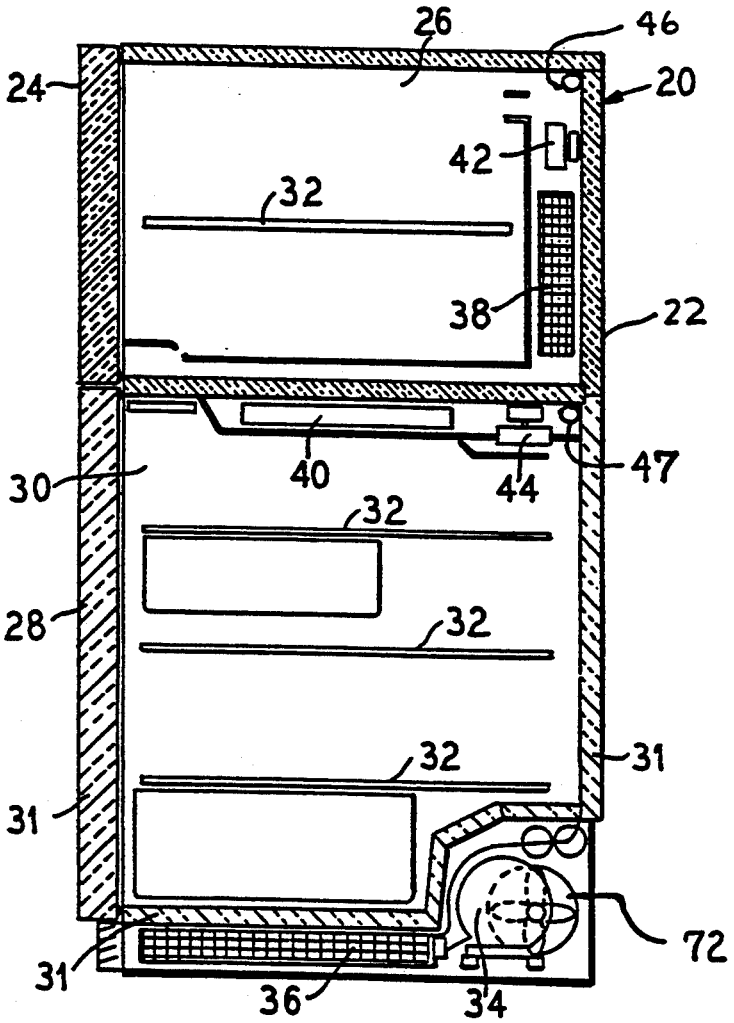
FIG. 2 is a side sectional view of the appliance of FIG. 1.

In FIGS. 1 and 2 there is shown generally a refrigeration appliance at 20 which comprises an exterior cabinet 22 having a first openable door 24 to expose a first interior compartment 26 and a second openable door 28 to expose a second interior compartment 30. Within each of the compartments 26, 30 there may be one or more shelves 32 for receiving food articles. Generally one of the components 26, 30 will be maintained at a temperature sufficiently below 0° C. to assure that all of the articles contained within that compartment will be maintained in a frozen state. The other compartment generally is maintained somewhat above 0° C. to maintain the items placed therein in a chilled, but not frozen condition.

In order to maintain the compartments at the desired temperature levels, a refrigeration device is provided which comprises a motor driven compressor 34, a condenser 36, an evaporator 38 for the first compartment 26 and a second evaporator 40 for the second compartment 30. Appropriate motor driven air moving devices 42, 44 such as fans or blowers are provided for circulating air within each of the compartments past its respective evaporator to maintain a fairly consistent temperature throughout each compartment.

Figure 3:
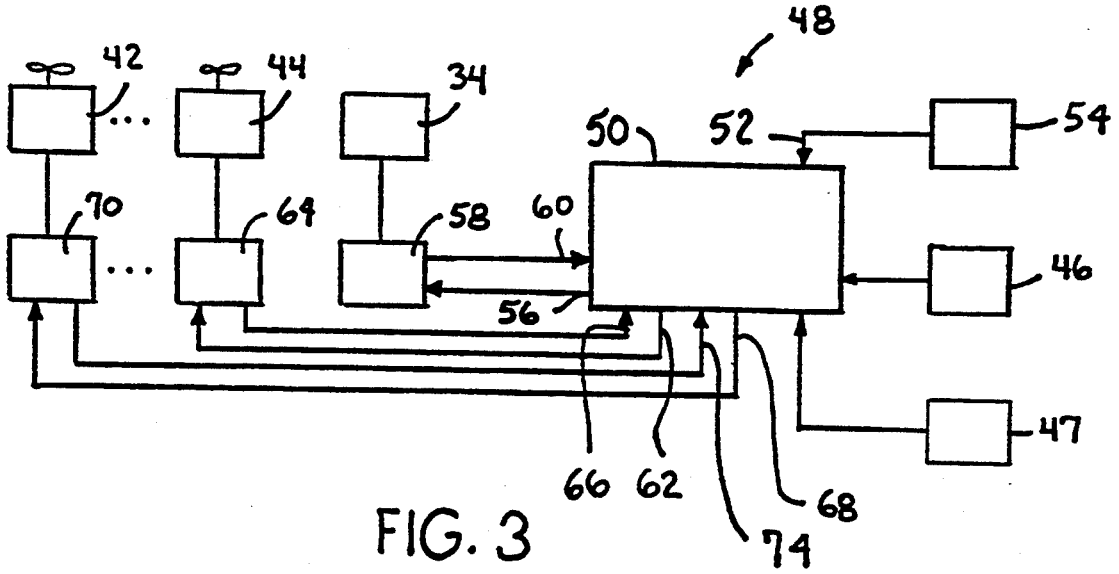
FIG. 3 is a schematic block diagram of the microprocessor speed control system of the present invention.

A temperature sensor 46, 47 is provided for each compartment 26, 30 to provide appropriate signal inputs to a control 48 (FIG. 3) for the appliance.

The control 48 has a microprocessor 50 which has an input 52 and a memory device 54 where various data used by the microprocessor 50 can be stored. The microprocessor 50 has a first output 56 for sending a signal out to a speed control device 58 which operates the compressor 34. The microprocessor 50 also has an input 60 for receiving a feedback signal from the speed control device 58 so that the operating speed of the compressor motor can be precisely controlled.

The microprocessor 50 has another output 62 to send an appropriate signal to a second speed control device 64 which operates the fan motor 44. Again, the microprocessor 50 has an input 66 to receive a feedback signal from the speed controller 64 to assure that the fan motor 44 is operated at a precise speed. The microprocessor 50 has additional outputs 68 such as to be connected to additional speed control devices 70 for operating additional motors such as fan motor 42. Other motors and fans may be operated in the refrigeration device such as a fan 72 for the condenser. Again, the microprocessor would have an input 74 from the feed controller 70 for a feedback signal to assure that the motor was operated at the precise speed.

The refrigeration appliance cabinet 22 and various of the components such as shelves, drawers, doors, panels, etc. each have natural or resonant frequencies which cause increased vibrations or noise when those components or assemblies are vibrated at those frequencies. The operation of the various motors cause vibrations which cannot be completely damped out, thus, when any of the motors are operated at these natural or resonant frequencies, excessive noise or vibration will be generated within the appliance.

These various frequencies can be determined empirically by operating the appliance and individually varying the frequencies of the variable speed motors used in the appliance. The objectionable speed ranges for each motor can then be stored in the memory storage device 54. Also, combinations of various motor speeds of two or more motors might cause objectionable noise or vibration and those combinations can be stored in the memory storage device 54 as well.

Then, as the appliance is operated, and the temperature sensors 46, 47 send signals to the microprocessor 50 demanding different levels of cooling and thus various speeds of operation of the various motors, the microprocessor can control the speeds of the motors and, by consulting the prohibited speed ranges stored in the memory storage device 54 for each motor, can prevent each of the motors from being operated at a prohibited speed.

Preferably, when one of the temperature sensors 46, 47 sends a signal to the microprocessor 50 requiring a certain motor to be operated within a prohibited speed range, the microprocessor will operate the motor at a first speed outside of the prohibited speed range, such as at a speed lower than that required for a first period of time, and then at a speed higher than that required, also outside the prohibited range, for a second period of time. Preferably the combination of the two speeds and running times will approximate the result had the motor been run at the required speed. Thus, the demanded result will be achieved, yet the production of excessive noise or vibration will be avoided.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A microprocessor speed control system for a refrigeration apparatus for controlling a speed of at least one variable speed motor, comprising:

an input for receiving demands to vary a speed of said motor, a memory where predetermined speed ranges are kept, and means for preventing said motor from operating at said predetermined speed ranges.

2. A microprocessor speed control system according to claim 1, wherein said motor comprises a fan motor.

3. A microprocessor speed control system according to claim 1, wherein said motor comprises a compressor motor.

4. A microprocessor speed control system according to claim 1, wherein at least two motors are separately controlled by said control system.

5. A microprocessor speed control system according to claim 4, wherein said predetermined speed ranges comprise speeds where unfavorable interactions between said motors occur.

6. A microprocessor speed control system according to claim 1, wherein said predetermined speed ranges comprise resonant and natural frequencies of said refrigeration apparatus.

7. A method of operating one or motors in a refrigeration apparatus at a variable speed and minimizing noise and vibration comprising:

determining speed ranges of said motor which cause excessive levels of noise in said apparatus;

storing said determined speed ranges in a memory accessible by a microprocessor based control;

controlling a speed of said motor in response to varying demands of said appliance; and preventing said motor from being operated at any of said stored speed ranges.

8. A method of operating one or motors in a refrigeration apparatus at a variable speed and minimizing noise and vibration comprising:

determining speed ranges of said motor which cause excessive levels of noise in said apparatus;

storing said determined speed ranges in a memory accessible by a microprocessor based control;

controlling a speed of said motor in response to varying demands of said appliance; and preventing said motor from being operated at any of said stored speed ranges; wherein when said demands of said appliance require operating said motor within one of said stored speed ranges, said motor is operated at a first speed outside of said stored speed range for a first period of time and subsequently at a second speed outside of said stored speed range for a second period of time such that the combined speeds and time periods will approximate said motor being run at said demanded speed.

9. A method according to claim 8, wherein said first speed is lower than said demanded speed and said second speed is higher than said demanded speed.

10. A refrigeration appliance comprising:

at least one variable speed motor;

a control system for controlling a speed of said variable speed motor;

means for demanding that said motor operate at different speeds;

said control system having an input for receiving demands to vary said speed of said motor, a memory where predetermined speed ranges for said motor are stored, and means for preventing said motor from operating at said predetermined speed ranges.

11. A microprocessor speed control system according to claim 10, wherein said motor comprises a fan motor.

12. A microprocessor speed control system according to claim 10, wherein said motor comprises a compressor motor.

13. A microprocessor speed control system according to claim 10, wherein at least two motors are separately controlled by said control system.

14. A microprocessor speed control system according to claim 13, wherein said predetermined speed ranges comprise speeds where unfavorable interactions between said motors occur.

15. A microprocessor speed control system according to claim 10, wherein said predetermined speed ranges comprise resonant and natural frequencies of said refrigeration apparatus.

* * * * *